US006659685B1

(12) United States Patent
Persson

(10) Patent No.: US 6,659,685 B1
(45) Date of Patent: Dec. 9, 2003

(54) ARRANGEMENT FOR COOLING A HYDRAULIC FLUID IN A HYDRAULIC-POWERED VIBRATING COMPACTOR

(75) Inventor: Gert Persson, Lyckeby (SE)

(73) Assignee: Svedala Compaction Equipment AB, Karlskrona (SE)

( * ) Notice: Subject to any disclaimer, the term of this patent is extended or adjusted under 35 U.S.C. 154(b) by 0 days.

(21) Appl. No.: 09/487,871

(22) Filed: Jan. 20, 2000

(51) Int. Cl.[7] ..... E01C 19/32
(52) U.S. Cl. ..... 404/133.1; 404/133.05
(58) Field of Search ..... 404/95, 133.05, 404/133.1; 454/143, 162, 237, 241, 251; 123/41.49, 41.01, 41.46, 41.48; 173/171, DIG. 4; 180/68.1

(56) References Cited

U.S. PATENT DOCUMENTS 2,467,018 A * 4/1949 Eggleston ..... 236/91 R
3,628,601 A * 12/1971 Snaper et al. ..... 165/47
3,899,263 A * 8/1975 Briggs et al. ..... 404/133.05
3,977,490 A * 8/1976 Flaig ..... 180/68.5
4,189,020 A * 2/1980 Abels et al. ..... 180/54 A
4,240,326 A * 12/1980 Carle ..... 91/39
4,861,187 A * 8/1989 Sinkkonen ..... 404/72
4,934,449 A * 6/1990 Watt et al. ..... 165/41
5,014,660 A * 5/1991 Westerbeke, Jr. ..... 123/198 E
5,101,885 A * 4/1992 Drake ..... 165/47
5,125,378 A * 6/1992 Westerbeke, Jr. ..... 123/198 E
5,139,362 A * 8/1992 Richter et al. ..... 404/95
5,207,187 A * 5/1993 Kurohara et al. ..... 123/41.7
5,216,983 A * 6/1993 Nilson ..... 123/41.12
5,489,150 A * 2/1996 Whiteman, Jr. ..... 366/46
5,839,397 A * 11/1998 Funabashi et al. ..... 123/41.01
6,109,826 A * 8/2000 Mertes ..... 404/95
6,129,056 A * 10/2000 Skeel et al. ..... 123/41.49
6,192,839 B1 * 2/2001 Takeshita et al. ..... 123/41.49
6,226,994 B1 * 5/2001 Yamada et al. ..... 62/3.7
6,227,153 B1 * 5/2001 Till ..... 123/41.12

* cited by examiner

*Primary Examiner*—Gary S. Hartmann
(74) *Attorney, Agent, or Firm*—Walter Ottesen

(57) ABSTRACT

The invention is directed to an arrangement for cooling the hydraulic fluid in a hydraulic-powered vibrating compactor. The arrangement includes a hydraulic pump (6) of the compactor. The hydraulic pump (6) is provided with a through shaft having a fan wheel (7) mounted on the free end (8) thereof. The fan wheel (7) is located to draw cooling air (15) through a duct (10) formed by a tunnel-shaped hydraulic fluid reservoir (9). This arrangement reduces the temperature of the hydraulic fluid in the hydraulic-powered vibrating compactor.

6 Claims, 2 Drawing Sheets

ARRANGEMENT FOR COOLING A HYDRAULIC FLUID IN A HYDRAULIC-POWERED VIBRATING COMPACTOR

FIELD OF THE INVENTION

The invention relates to an arrangement for achieving efficient cooling of the hydraulic fluid in a hydraulic-powered vibrating compactor.

1. Background of the Invention

With a hydraulic drive, heat is generated in the hydraulic system due to pressure losses. Known arrangements for cooling the hydraulic fluid of the system include a sufficiently large hydraulic fluid reservoir or a conventional oil cooler. However, small compactors in particular preclude the first of these solutions because an oil cooler is both bulky and expensive.

2. Summary of the Invention

It is an object of the invention to provide a hydraulic-powered vibrating compactor with efficient cooling of the hydraulic fluid in a simple and cost effective manner.

The arrangement of the invention is for cooling hydraulic fluid in a hydraulic-powered vibrating compactor and includes a chassis, a casing mounted on the chassis and a reservoir defining an interior for the hydraulic fluid. The arrangement includes: the reservoir being disposed below the casing and having a lower wall defining a tunnel and an upper wall in spaced relationship to the casing so as to define a passage communicating with the atmosphere external of the casing; the lower wall and the upper wall enclosing at least a portion of the interior; a hydraulic pump connected to the chassis and having a through rotatable shaft defining a free end; a fan wheel mounted on the free end; the hydraulic pump being mounted so as to permit the fan wheel to draw cooling air through the tunnel for cooling the hydraulic fluid in the reservoir; and, means for directing the cooling air from the tunnel and into the passage so as to permit the cooling air to pass over the upper wall to further cool the hydraulic fluid in the reservoir and to discharge to the atmosphere outside of the casing.

The arrangement of the invention is especially advantageous because the feasibility of using conventional cooling methods is limited by the size of the machine.

Another purpose of the invention is to permit the use of environmentally compatible biofluids which, as is known, cannot withstand high temperatures. This is achieved by configuring the fluid reservoir in the shape of a tunnel and providing the hydraulic pump with a through shaft having a fan wheel mounted on one end. Installed in the duct formed by the tunnel-shaped reservoir, the fan wheel generates a flow of cooling air in the duct and this flow is directed further along the top of the reservoir by a baffle plate. Practical tests using this arrangement have shown that the fluid temperature is reduced by approximately 30° C. and that an operating temperature of approximately 50° C. above ambient is achieved thereby enabling biofluids to also be used.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
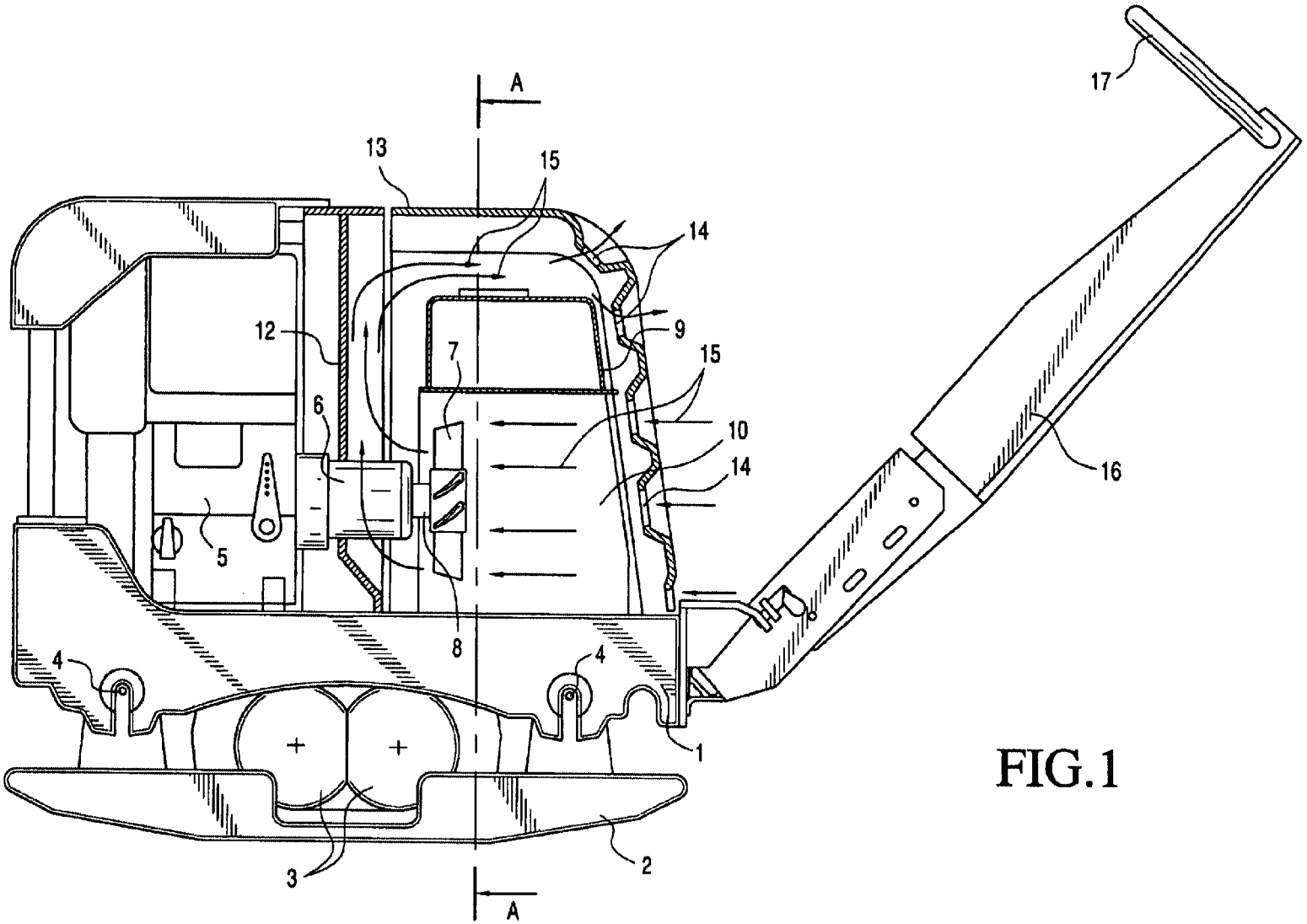
FIG. 1 is a side elevation view of a vibrating compactor with a portion broken away to show the arrangement according to the invention for cooling the hydraulic fluid; and, FIG. 2 is a section view of the vibrating compactor taken along line A—A of FIG. 1.

In FIG. 1, the vibrating base plate 2 of the vibrating compactor is provided with eccentric elements 3 and is attached to the chassis 1 via four vibration dampers 4. The chassis is equipped with an internal combustion engine 5 driving a hydraulic pump 6. The pump 6 has a through shaft with a fan wheel 7 mounted on the free end 8 of the shaft. A hydraulic reservoir 9 is mounted on the chassis. The reservoir is so configured that its inner side walls 11 form a duct or tunnel 10 through which the fan wheel 7 draws in air. The air is directed upward with the aid of the baffle plate 12 to the top cover 13 of the compactor casing and then passes over the upper wall 19 of the hydraulic fluid reservoir 9 and is discharged through a grille in the side 14 of the compactor casing facing the handle 16. The air flow is indicated by the arrows 15 in FIG. 1. The handle grip is identified by reference numeral 17.

Figure 2:
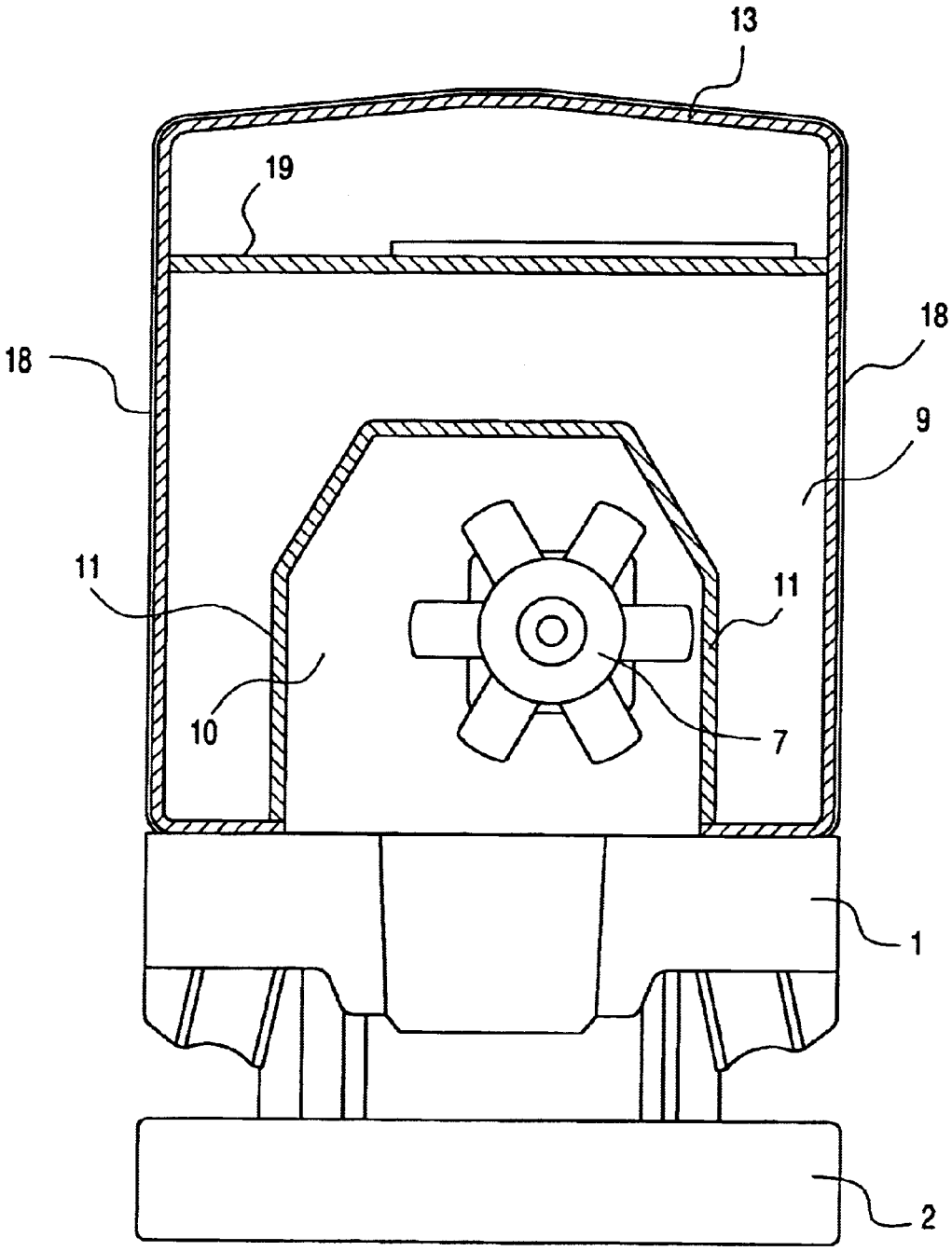

FIG. 2 is a view taken along line A—A of FIG. 1 and shows the shape of the hydraulic reservoir 9. The inner sidewalls 11 of the reservoir 9 form the duct 10 into which the hydraulic pump 6 and fan wheel 7 extend as shown in FIG. 1. The outer side walls of the reservoir are identified by reference numeral 18.

It is understood that the foregoing description is that of the preferred embodiments of the invention and that various changes and modifications may be made thereto without departing from the spirit and scope of the invention as defined in the appended claims.

What is claimed is:

1. A hydraulic-powered vibrating compactor comprising:

a chassis;

a vibrating base plate operatively connected to said chassis;

a casing mounted on said chassis and a reservoir defining an interior for hydraulic fluid;

said reservoir being disposed below said casing and having a lower wall defining a tunnel and an upper wall in spaced relationship to said casing so as to define a passage communicating with the atmosphere external of said casing;

said lower wall and said upper wall enclosing at least a portion of said interior;

a hydraulic pulp connected to said chassis and having a through rotatable shaft defining a free end;

a fan wheel mounted on said free end;

said hydraulic pump being mounted so as to permit said fan wheel to draw cooling air through said tunnel for cooling said hydraulic fluid in said reservoir directly through said lower wall; and, means for directing said cooling air from said tunnel and into said passage so as to permit said cooling air to pass over said upper wall to further cool said hydraulic fluid in said reservoir and to discharge to the atmosphere outside of said casing.

2. The hydraulic-powered vibrating compactor of claim 1, wherein said means includes a baffle plate mounted in said casing to deflect the air drawn through said tunnel to said passage.

3. The hydraulic-powered vibrating compactor of claim 1, said reservoir being mounted on said chassis so that said lower wall and said chassis conjointly define said tunnel.

4. The hydraulic-powered vibrating compactor of claim 1, said reservoir having a U-shaped configuration when viewed in section; said U-shaped section having a bight portion and two legs extending from said bight portion with said legs and said bight portion defining said interior containing said hydraulic fluid; and, said tunnel being at least partially defined by said bight portion and said two legs.

5. The hydraulic-powered vibrating compactor of claim 1, wherein said fan wheel is disposed in said tunnel.

6. A hydraulic-powered vibrating compactor comprising:

a chassis;

a vibrating base plate operatively connected to said chassis;

a casing mounted on said chassis and a reservoir defining an interior for hydraulic fluid;

said reservoir being disposed below said casing and having a lower wall defining a tunnel communicating with the atmosphere external of said casing;

said lower wall enclosing at least a portion of said interior;

a hydraulic pump connected to said chassis and having a through rotatable shaft defining a free end;

a fan wheel mounted on said free end;

said hydraulic pump being mounted so as to permit said fan wheel to draw cooling air through said tunnel for cooling said hydraulic fluid in said reservoir directly through said lower wall; and, a passage for directing said cooling air from said tunnel to the atmosphere outside of said casing.

* * * * *

UNITED STATES PATENT AND TRADEMARK OFFICE

CERTIFICATE OF CORRECTION

PATENT NO. : 6,659,685 B1
DATED : December 9, 2003
INVENTOR(S) : Gert Persson

It is certified that error appears in the above-identified patent and that said Letters Patent is hereby corrected as shown below:

Title page,
After Item [22], insert:
-- [30] Foreign Application Priority Data
January 26, 1999 (SE) …….9900226-3 --.

Column 2,
Line 44, delete "pulp" and substitute -- pump -- therefor.

Signed and Sealed this

Sixteenth Day of March, 2004

JON W. DUDAS
*Acting Director of the United States Patent and Trademark Office*